US011939114B2

(12) United States Patent
Shabtay

(10) Patent No.: US 11,939,114 B2
(45) Date of Patent: Mar. 26, 2024

(54) SELF-OPENING AND SELF-PLUGGING BOTTLE STOPPER

(71) Applicant: David Shabtay, RaAnana (IL)

(72) Inventor: David Shabtay, RaAnana (IL)

( * ) Notice: Subject to any disclaimer, the term of this patent is extended or adjusted under 35 U.S.C. 154(b) by 0 days.

(21) Appl. No.: 17/717,181

(22) Filed: Apr. 11, 2022

(65) Prior Publication Data

US 2023/0322446 A1 Oct. 12, 2023

(51) Int. Cl.
*B65D 39/12* (2006.01)
*B65D 39/00* (2006.01)

(52) U.S. Cl.
CPC ..... *B65D 39/12* (2013.01); *B65D 39/0052* (2013.01)

(58) Field of Classification Search
CPC ..... B65D 39/12; B65D 39/0058; B65D 39/0064; B65D 39/16; B65D 39/0052; B65D 51/243; B65D 51/1683; B67B 7/08; B67B 7/06; B67B 7/066; B67B 1/04
USPC ..... 215/296, 228, 307, 355; 81/3.2, 3.49, 81/3.48, 3.15; 141/19, 329, 60, 65, 8; 222/5
See application file for complete search history.

(56) References Cited

U.S. PATENT DOCUMENTS 2,729,124 A * 1/1956 Farandatos ..... B67B 7/08 D8/42
3,085,454 A * 4/1963 Federighi ..... B67B 7/08 81/3.2
3,135,144 A * 6/1964 Cameron ..... B67B 7/08 81/3.2
3,135,410 A 6/1964 Fedcrighi
3,815,448 A * 6/1974 Artmer ..... B67B 7/0405 81/3.2
4,317,390 A 3/1982 Nakayama
4,464,956 A * 8/1984 Hashimoto ..... B67B 7/08 81/3.2

(Continued)

FOREIGN PATENT DOCUMENTS

GB 2201146 8/1988
WO WO-2007022333 A2 * 2/2007 ..... B67B 7/08

(Continued)

OTHER PUBLICATIONS

International Preliminary Report on Patentability dated Feb. 15, 2011 From the International Bureau of WIPO Re. Application No. PCT/IB2009/053506. (5 Pages).

(Continued)

*Primary Examiner* — Chun Hoi Cheung
*Assistant Examiner* — Brijesh V. Patel

(57) ABSTRACT

A bottle stopper adapted for self-opening and self-plugging a bottle, comprising a cylindrical cover having a bottom end and a top end. The cylindrical cover is sized and shaped to plug a bottle. A cartridge is encompassed by the cylindrical cover and has a fluid chamber; the cartridge also has at least one lateral protrusion thereon to form between the cartridge and the cylindrical cover. There is at least one fluid channel for fluidly connecting between a space below the bottom end and above the top end. A conduit having at least one inlet and at least one outlet is for fluidly connecting transferring the fluid of the fluid chamber to outside of the bottle stopper. An activation cap is mounted to push the conduit along a longitudinal axis of the cylindrical cover from a closed state to an open state.

17 Claims, 16 Drawing Sheets

(56) References Cited

U.S. PATENT DOCUMENTS

| | | | | |
|---|---|---|---|---|
| 4,791,834 | A * | 12/1988 | Federighi | B67B 7/08 81/3.2 |
| 4,889,251 | A | 12/1989 | Hojnoski | |
| 5,012,703 | A | 5/1991 | Rcinbacher | |
| 5,020,395 | A | 6/1991 | Mackey | |
| 5,722,548 | A * | 3/1998 | Hojnoski | B65D 39/16 81/3.15 |
| 6,499,618 | B1 * | 12/2002 | Leclerc | B65D 39/00 215/307 |
| 6,502,481 | B1 * | 1/2003 | Lin | B67B 7/08 81/3.2 |
| 6,622,595 | B1 * | 9/2003 | Federighi | B67B 7/08 81/3.2 |
| 6,848,340 | B2 * | 2/2005 | Lin | B67B 7/08 81/3.2 |
| 7,234,375 | B1 * | 6/2007 | Wang Wu | B67B 7/08 81/3.36 |
| 10,000,320 | B2 | 6/2018 | Gagne | |
| 2002/0083797 | A1 * | 7/2002 | Federighi, Sr. | B67B 7/08 81/3.2 |
| 2017/0129664 | A1 * | 5/2017 | Hatamian | B65D 39/0064 |
| 2017/0129758 | A1 * | 5/2017 | Hume | B67B 7/08 |
| 2017/0275057 | A1 * | 9/2017 | Gonzalez Valencia | B65D 39/16 |
| 2019/0031481 | A1 * | 1/2019 | Soussan | B67B 7/08 |

FOREIGN PATENT DOCUMENTS

| | | |
|---|---|---|
| WO | WO 2010/018527 | 2/2010 |
| WO | WO 2016/125062 | 8/2016 |
| WO | WO 2023/199321 | 10/2023 |

OTHER PUBLICATIONS

Written Opinion dated Sep. 14, 2016 From the International Searching Authority Re. Application No. PCT/IB2016/050487. (5 Pages).

International Search Report and the Written Opinion dated Jul. 24, 2023 From the International Searching Authority Re. Application No. PCT/IL2023/050388 (21 Pages).

* cited by examiner

1300

SELF-OPENING AND SELF-PLUGGING BOTTLE STOPPER

FIELD AND BACKGROUND OF THE INVENTION

The disclosure relates to the bottling industry and more specifically to the plugging of bottles.

This disclosure and enablement relates to a bottle stopper device, also known as a cork having built-in self-opening and self-plugging features. The self-opening feature eliminates the need for a tool; one example tool is a corkscrew for opening a wine bottle. The self-opening and self-plugging bottle stopper is for all liquids, including wine, other beverages, and non-beverages. The self-plugging feature prevents the bottle stopper from ejecting, and flying out of the bottle during the self-opening, (uncorking process) where self-plugging halts the bottle stopper,

SUMMARY OF THE INVENTION

A bottle stopper device is adapted for self-opening and self-plugging a bottle. The device comprises: a cylindrical cover having a bottom end and a top end, wherein the cylindrical cover is sized and shaped to plug a bottle, a cartridge encompassed by the cylindrical cover and having: a fluid chamber, at least one lateral protrusion thereon to form between the cartridge and the cylindrical cover at least one fluid channel for fluidly connecting between a space below the bottom end and above the top end. The conduit has at least one inlet and at least one outlet. An activation cap is mounted to push the conduit along a longitudinal axis of the cylindrical cover from a closed state to an open state. In the open state, the at least one outlet extends beyond the bottom end and the at least one inlet is fluidly connected to the fluid chamber. In the closed state, the at least one outlet and the at least one inlet are mounted between the bottom end and the top end.

The following aspects are various implementations of the bottle stopper device adapted for self-opening and self-plugging a bottle. In one implementation, the conduit further comprises a conduit tip having a range between a 30 to a 60 degree angle measured along the longitudinal axis of the bottle. In one implementation, the cylindrical cover is a solid cylindrical cover drilled to create the hollow cylindrical cover; wherein the drill bit for drilling having a diameter in a range between 10 millimeters and 10.5 millimeters. In one implementation, the hollow cylindrical cover having the following dimensions: (1) an inner diameter in a range between 9.5 millimeters and 11 millimeters, (2) an outer diameter in a range between 24 millimeters and 25 millimeters, and (3) a vertical height in a range between 43 millimeters and 45 millimeters. In one implementation the cartridge further comprises an upper valve connecting to a lower valve via a male and female screwing connection; wherein cartridge having steel walls suitable for welding selected from a group consisting of: L304, and L316. In one implementation, the upper valve ingests the activation cap; wherein the upper valve having a top end connecting to a closing nut and a pin assembled in the closing nut; wherein the activation cap further comprises a cylindrical protrusion with at least one slit; wherein the pin is a locking pin passing thorough the at least one slit to prevent removing the activation cap from the upper valve. In one implementation, the lower valve has at least one inlet thereon to ingress the fluid from the fluid chamber into the lower valve; wherein in the closed state, the lower valve has at least two O-rings encompassing the conduit, wherein the at least one inlet and the at least one outlet are located between O-rings; and wherein in the open state, the at least one inlet is fluidly connected to the fluid chamber and the at least one outlet extends beyond the at least one O-ring for the at least one outlet to extend beyond the bottom end. In one implementation, the conduit has a top end positioned vertically coupling to the activation cap, wherein the activation cap has a cylindrical protrusion forming at least two prongs at a bottom end for coupling to the conduit; wherein pulling the activation cap causes the at least two prongs to separate from the conduit. In one implementation, the conduit is positioned in the center of the cartridge. In one implementation, the conduit is positioned along the side of the cartridge. In one implementation, pulling the activation cap can cause contracting and expanding, where the prongs are a first element and where the conduit is a second element, the first and second elements are selected from a group consisting of: (1) the prongs are contracting in diameter and there is no change to the conduit, and (2) the conduit is expanding in diameter and there is no change to the prongs. In one implementation, the bottle stopper plugs a wine bottle. In one implementation, the wine bottle has a wine bottle pressure range between 2.4 bars and 7 bars; wherein in the open state a fluid pressure greater than 5 bars can move the bottle stopper to unplug the bottle. In one implementation, the fluid chamber of the bottle stopper contains a nitrogen fluid; wherein the fluid chamber has a pressure range between 45 bars and 47 bars. In one implementation, the cartridge having at least one lateral protrusion further comprises at least one gap adjacent to the at least one protrusion joining to the cylindrical cover for moving in tandem to unplug the bottle during the open state. In one implementation, the at least one gap lowers the fluid pressure from moving the bottle stopper upwards; wherein the bottle stopper halts after moving upwards in a range from 30 millimeters to 38 millimeters. In one implementation, the bottle stopper is a champagne stopper for a champagne bottle.

The following is a method of manufacturing bottle stoppers. The manufacturing method comprises the following steps: (1) inserting via a molding machine, a cartridge having at least one lateral protrusion into a mold; (2) adding via a molding machine, a cork powder for molding into a cylindrical cover; wherein the cylindrical cover is joining to the cartridge having at least one lateral protrusion; (3) heating the mold comprising the cartridge having at least one lateral protrusion with the cork powder wherein the cork powder joins with the cartridge having at least one lateral protrusion; and (4) cooling the mold for forming the solid self-opening and self-stopping bottle stopper. In one implementation, the mold is heated to a maximum of 130 degrees Celsius for forming the bottle stopper adapted for self-opening and self-plugging. In one implementation, the cartridge has a maximum of a 140 bar pressure limit during the heating of the mold.

Unless otherwise defined, all technical and/or scientific terms used herein have the same meaning as commonly understood by one of ordinary skill in the art to which the description pertains. Although methods and materials similar or equivalent to those described herein can be used in the practice or testing of embodiments of the description, exemplary methods and/or materials are described below. In case of conflict, the patent specification, including definitions, will control. In addition, the materials, methods, and examples are illustrative only and are not to be limiting.

BRIEF DESCRIPTION OF THE SEVERAL VIEWS OF THE DRAWING(S)

Described are embodiments of the teaching, for example only, regarding the accompanying drawings. With specific reference now to the drawings, the details shown are, for example, and for an illustrative discussion of embodiments of the description. The description taken with the drawings makes apparent to those skilled in the art how to practice embodiments of the description.

Figure 6A:
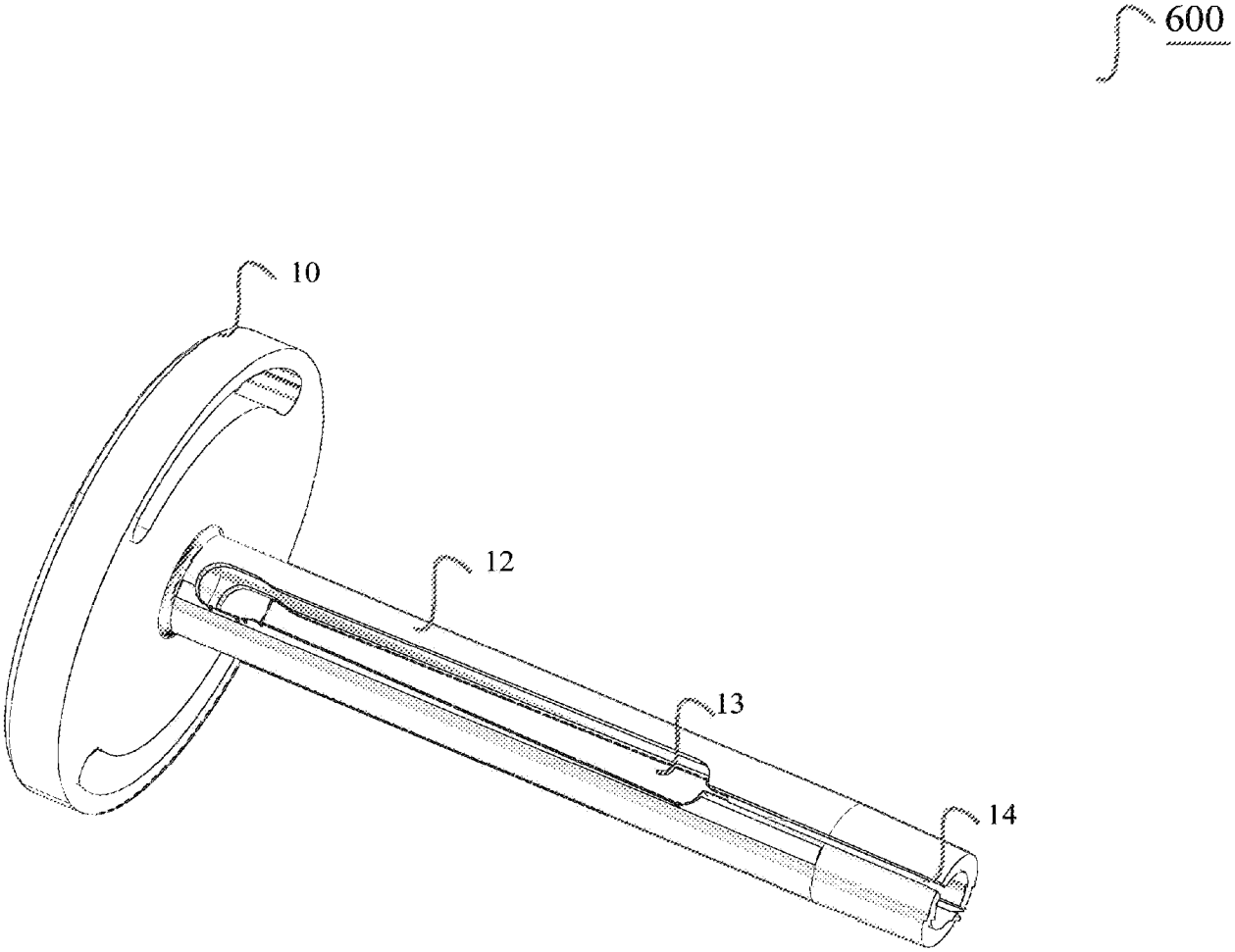

FIG. 6*a* shows a perspective view of an activation cap.

Figure 6B:
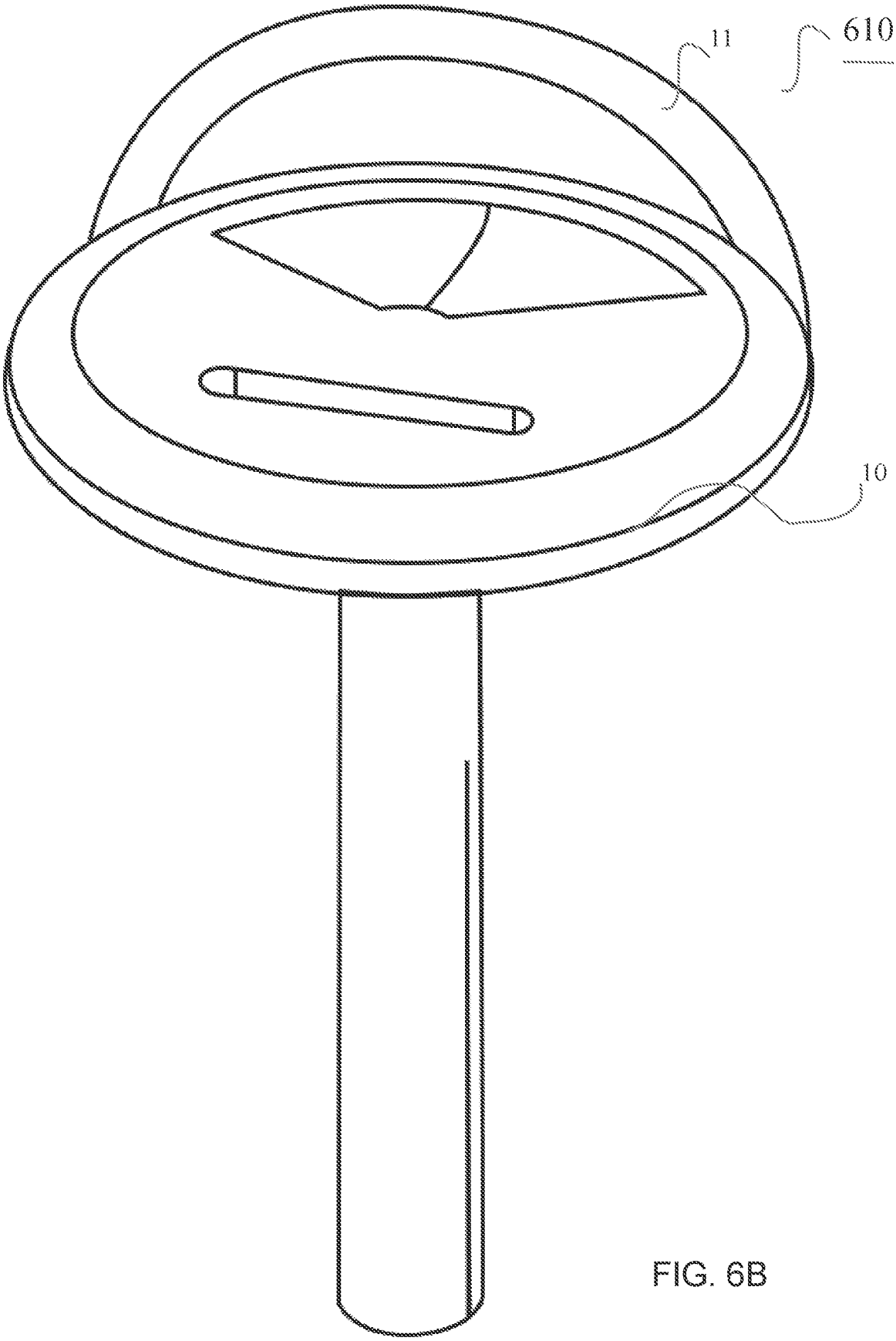

FIG. 6*b* shows a perspective view of an activation cap with a pull-ring.

Figure 7:
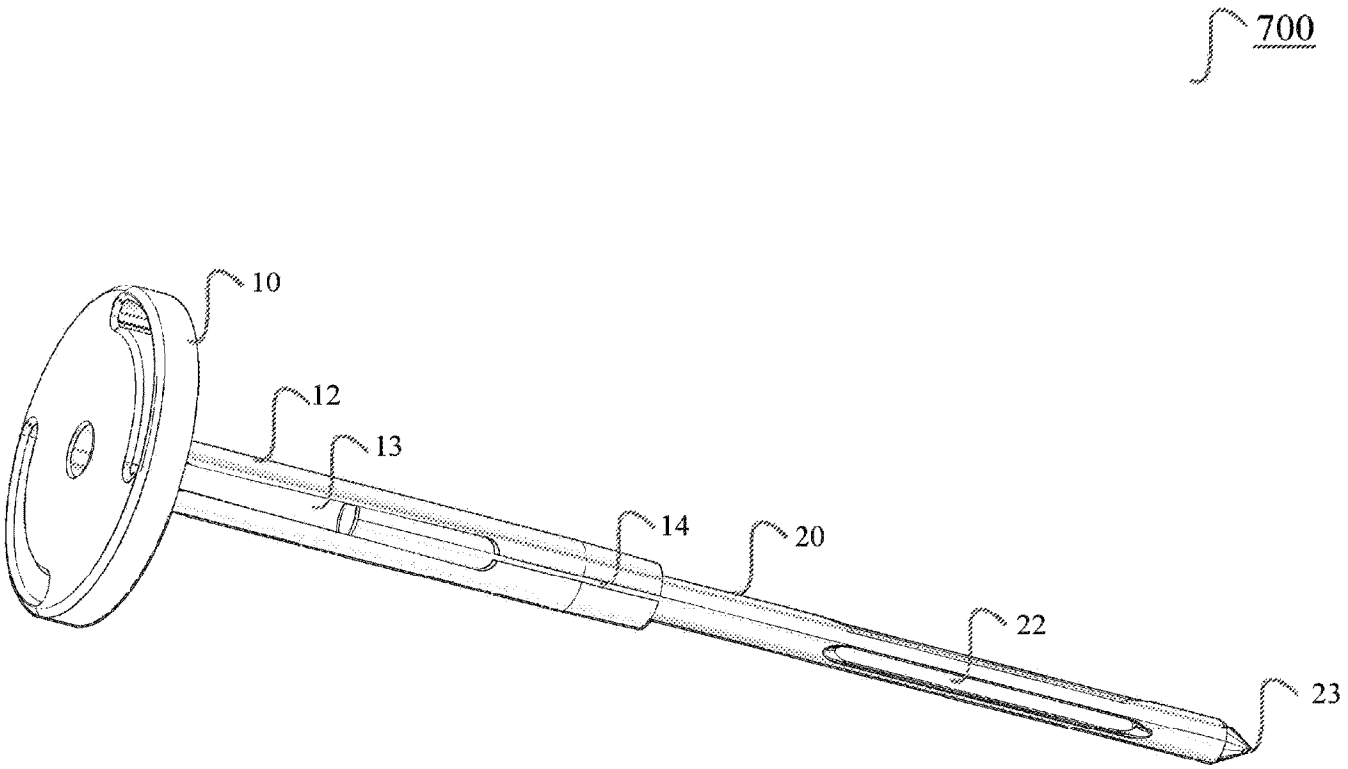

FIG. 7 shows a perspective view of an activation cap with a conduit.

Figure 8:
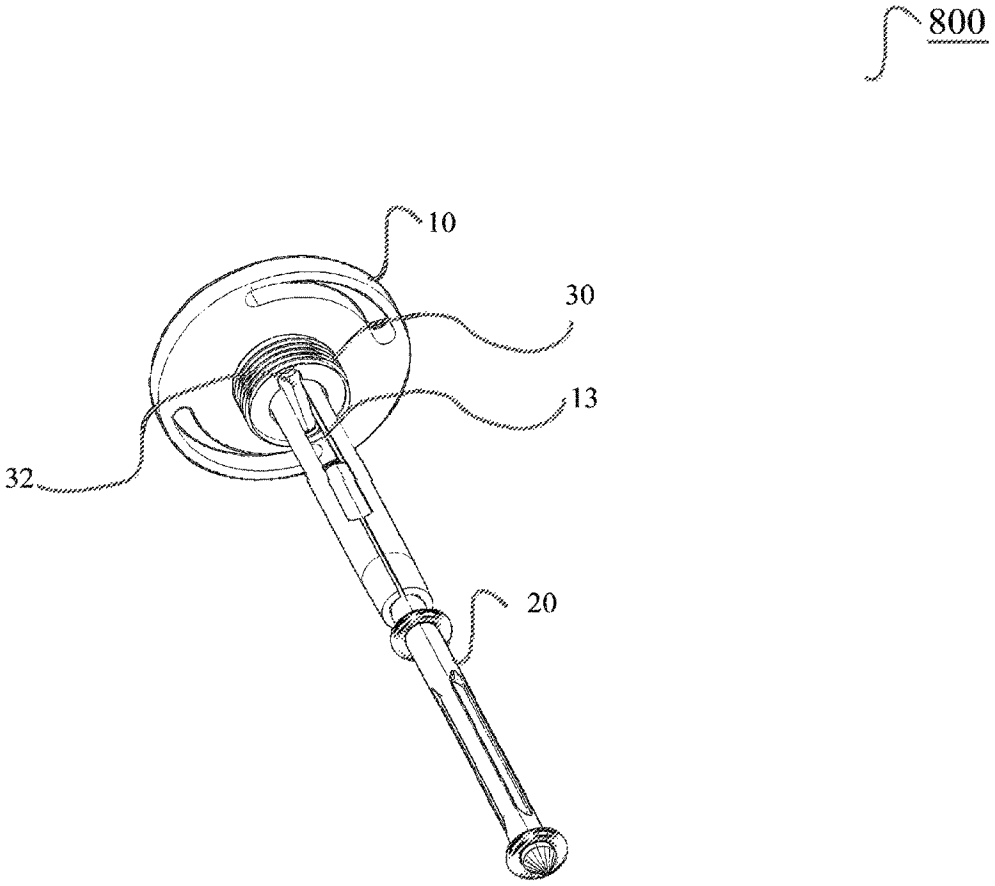

FIG. 8 further shows a perspective view of an activation cap with a closing nut, a pin, and O-rings.

Figure 9:
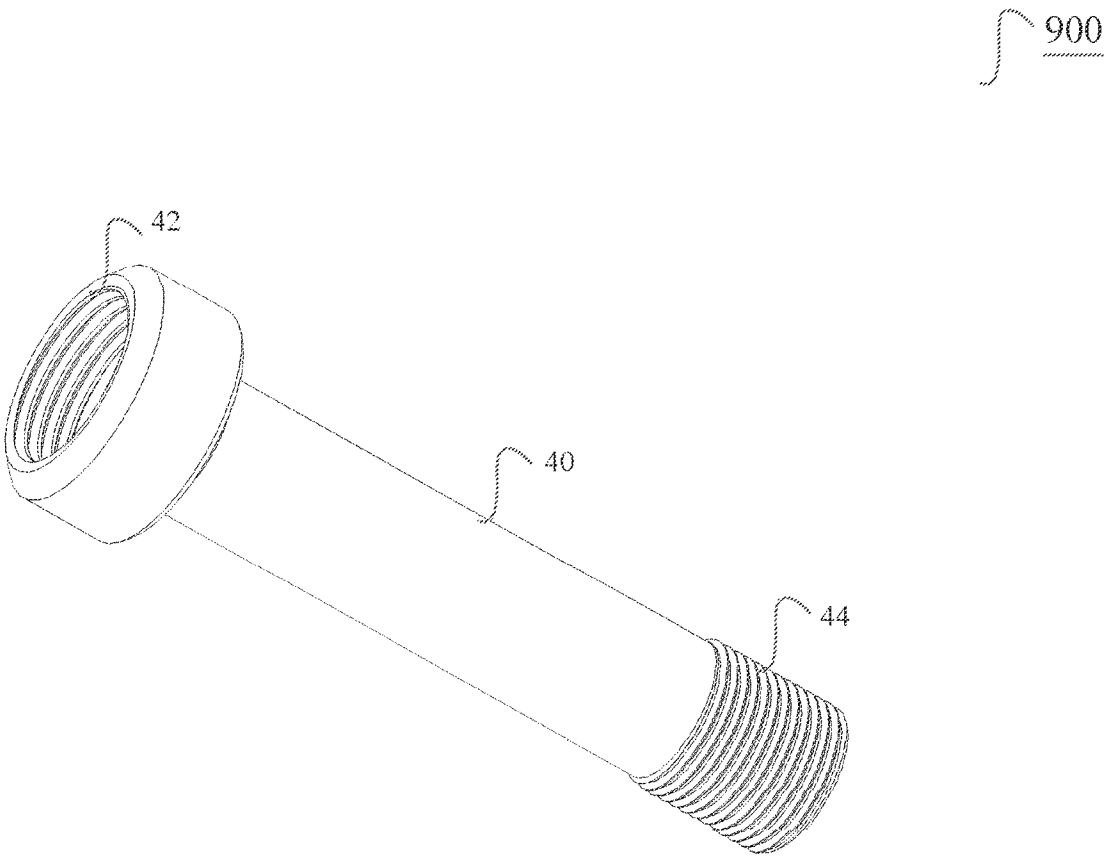

FIG. 9 shows a perspective view of an upper first valve.

Figure 10:
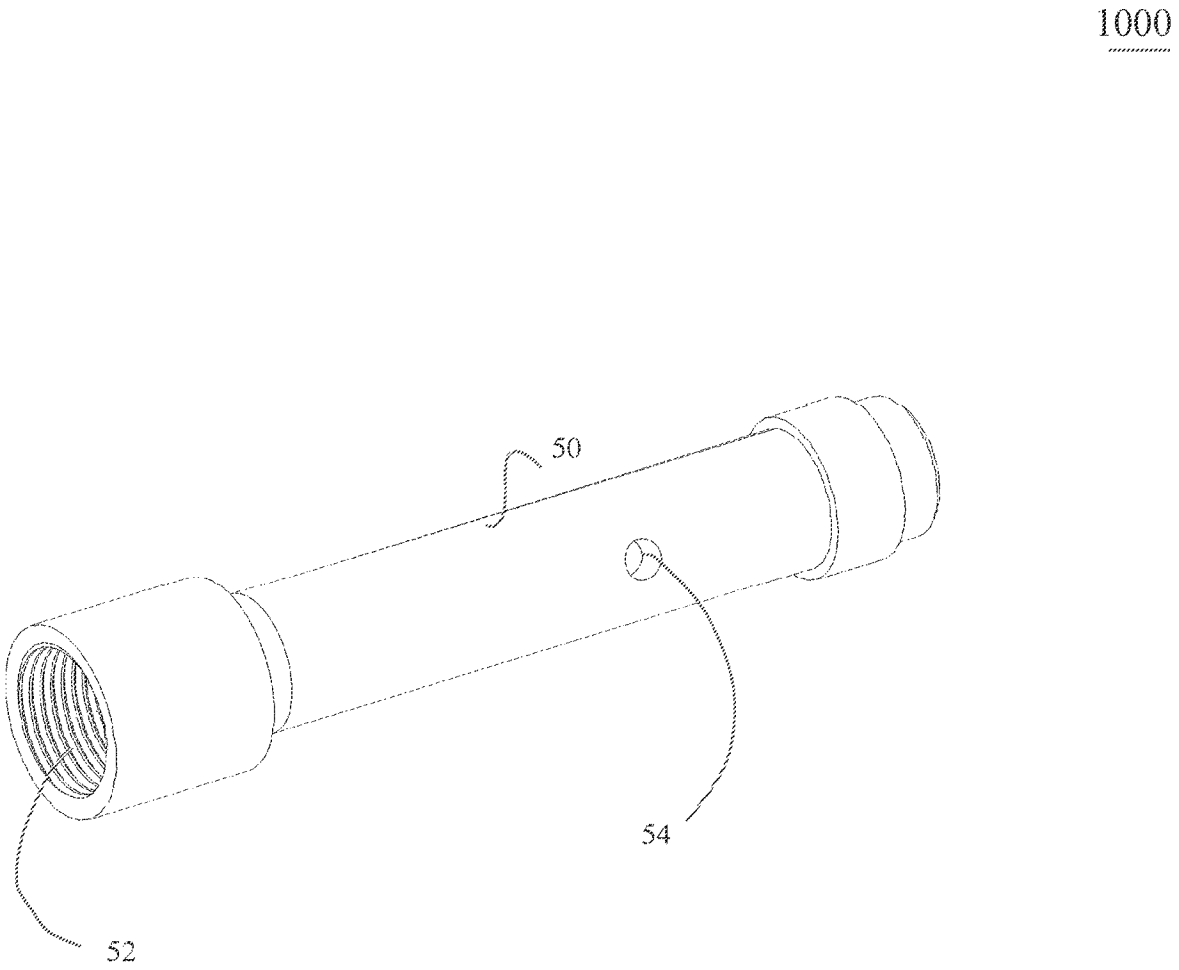

FIG. 10 shows a perspective view of a lower second valve with at least one gas ingress hole.

Figure 11:
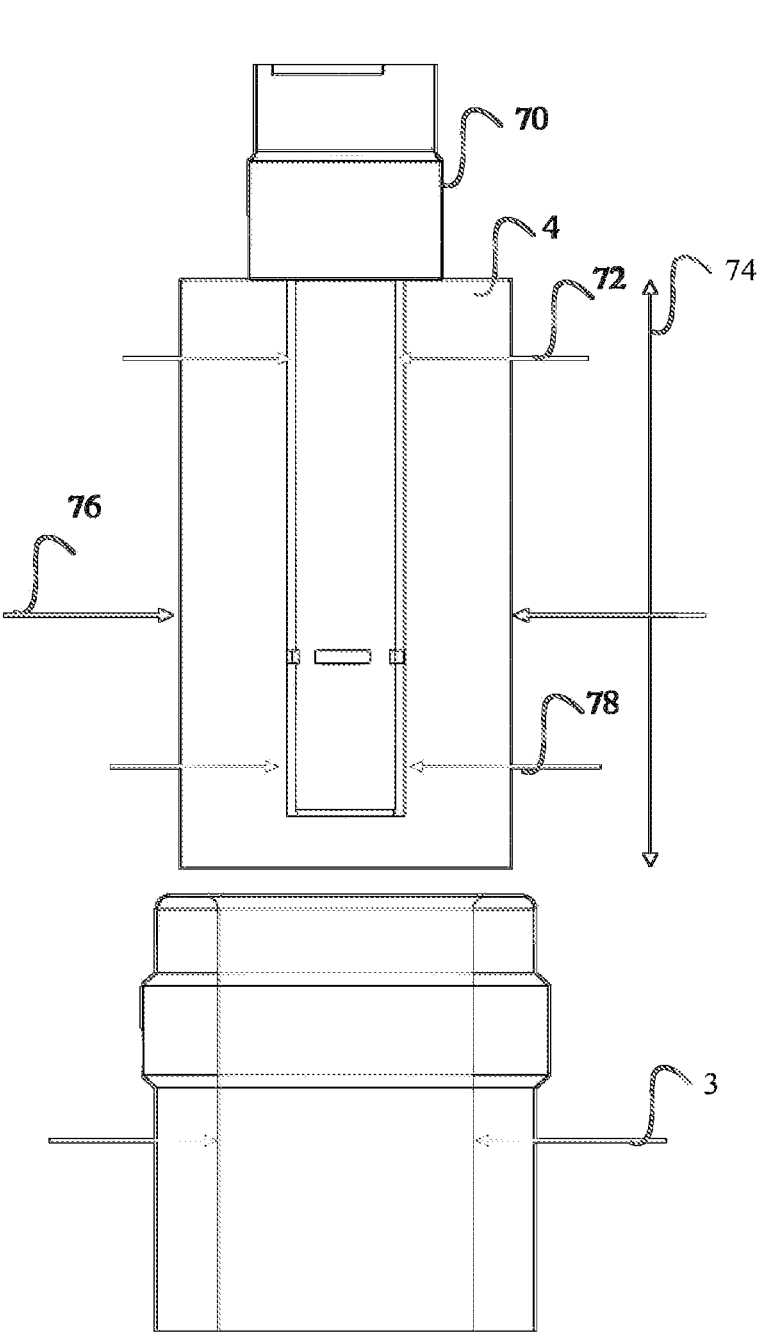

FIG. 11 shows a sectional view before inserting the bottle stopper into a bottle.

Figure 12:
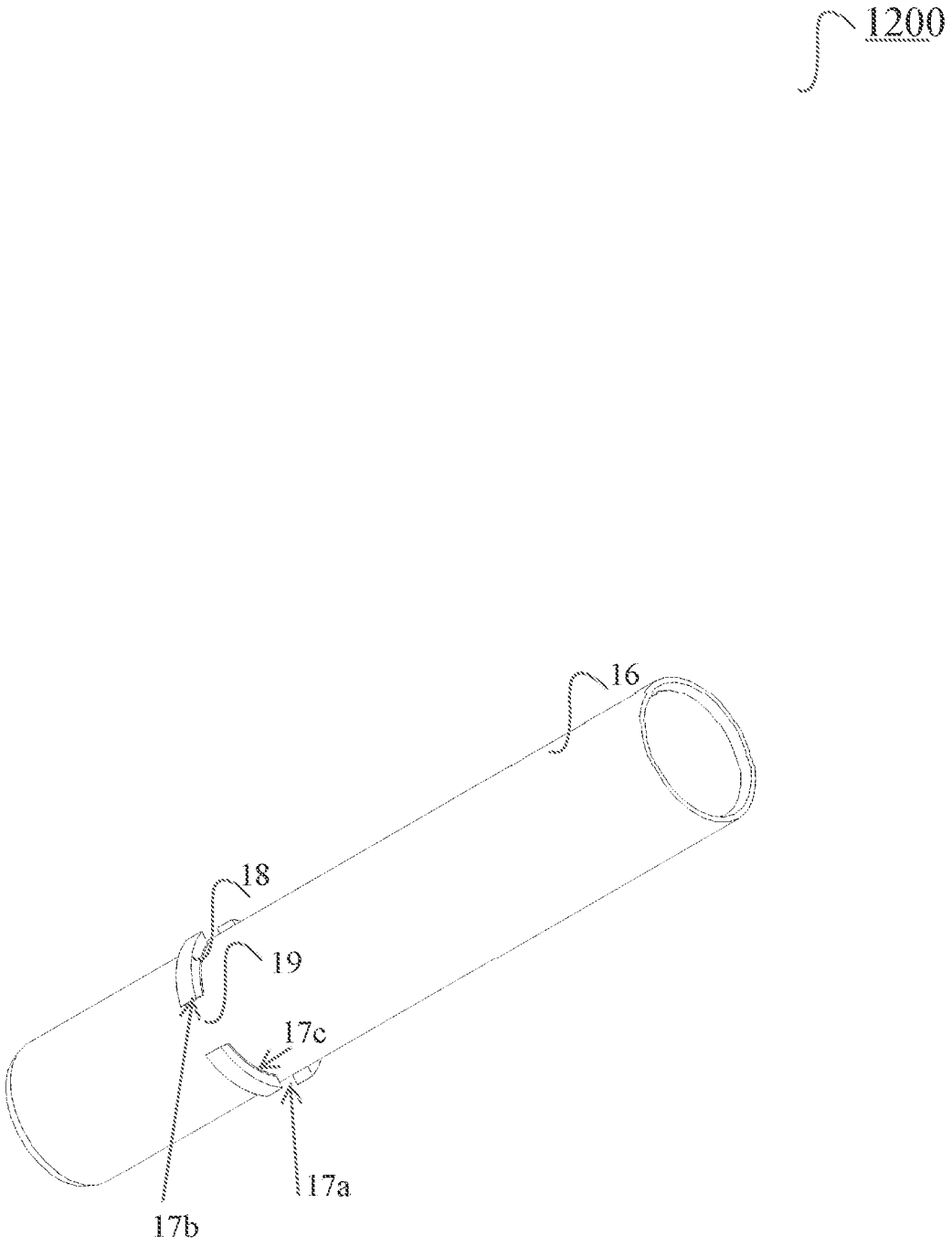

FIG. 12 further shows a perspective view of a cartridge with at least one lateral protrusion.

Figure 13:
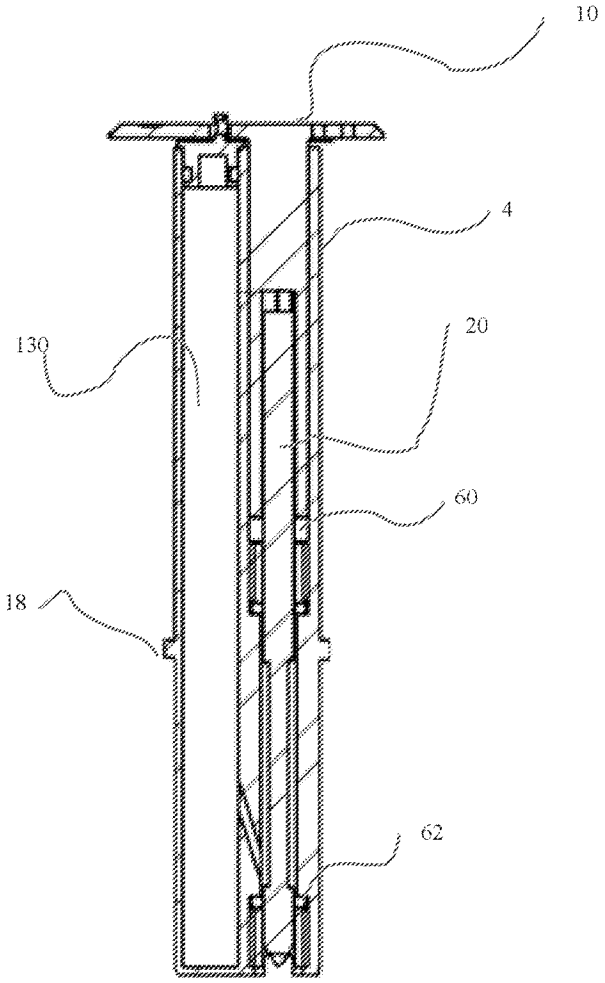

FIG. 13 shows a bottle stopper with an activation cap assembled on the side.

Figure 14:
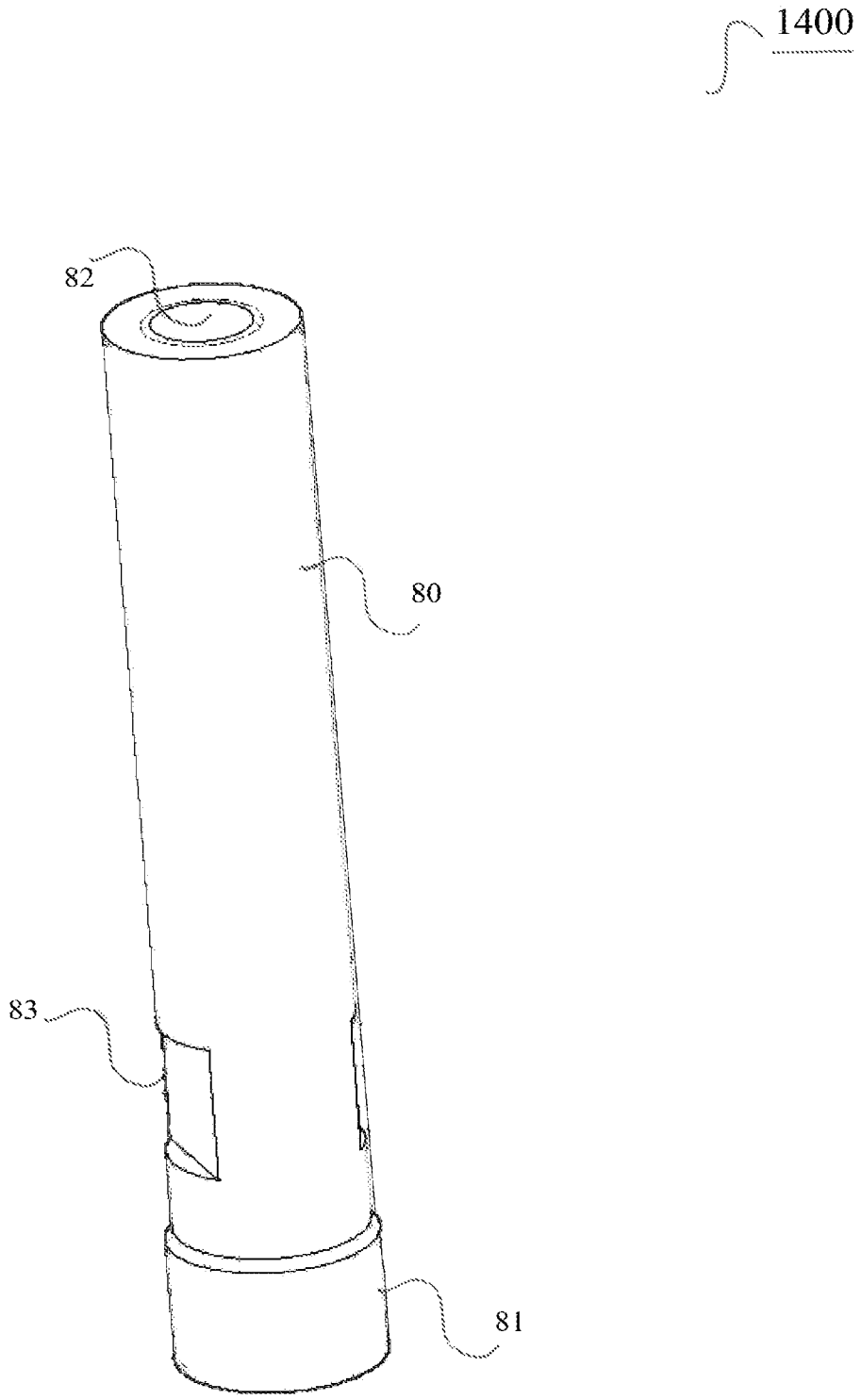

FIG. 14 shows a perspective view of a bottle plugging tool.

Figure 15:
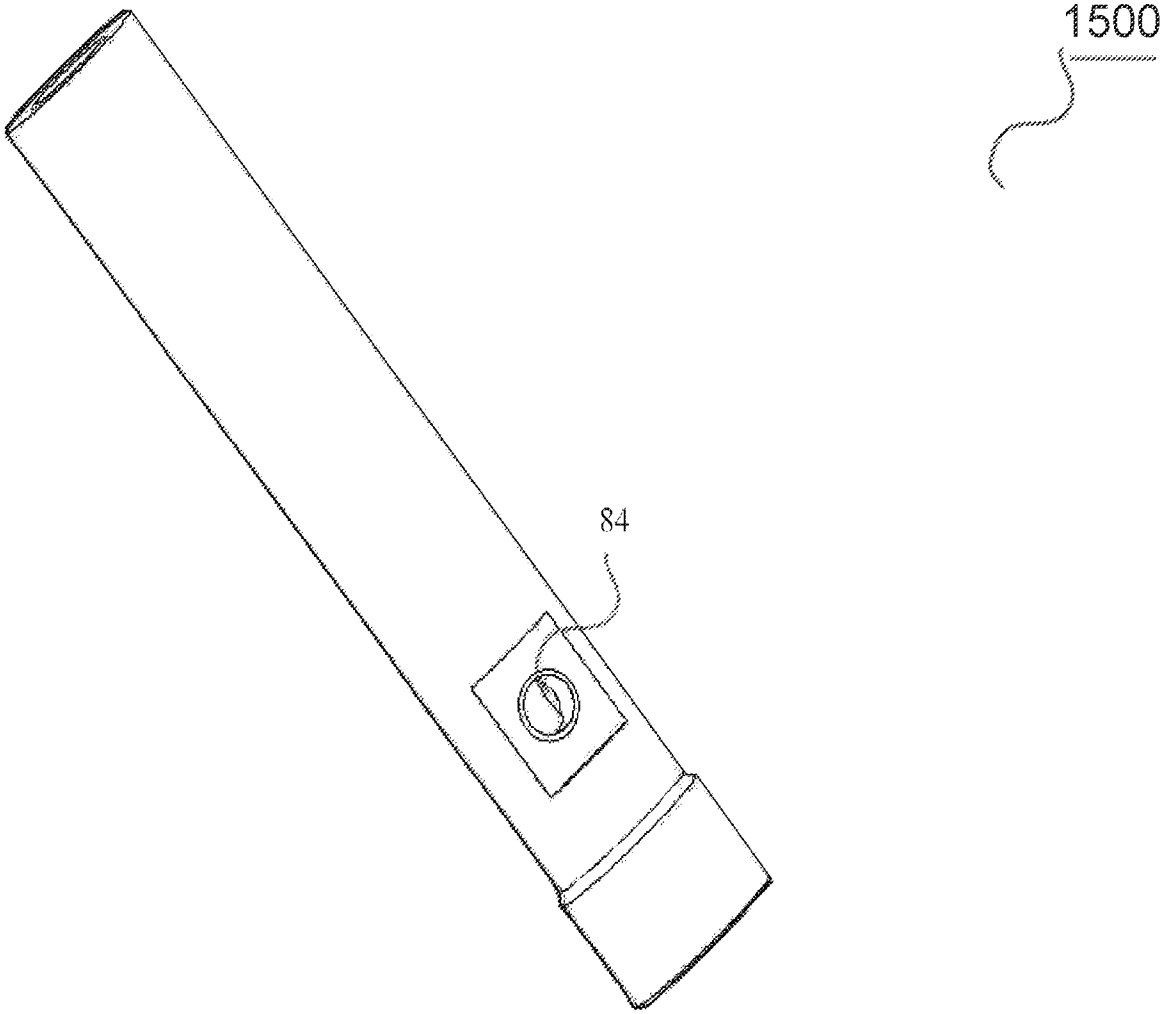

FIG. 15 further shows a perspective view of a bottle plugging tool with a fluid inlet port.

DESCRIPTION OF SPECIFIC EMBODIMENTS OF THE INVENTION

The disclosure describes a bottle stopper adapted for self-opening and self-plugging a bottle. Activating the bottle stopper for self-opening occurs by first pulling on and then pushing down on an activation cap. After initiating the activation act, the bottle stopper can move itself in an upward direction, in a direction moving out of the bottle. Activation does not require external tools, such as a corkscrew. A definition of self-plugging is where the bottle-stopper can halt/stop the self-opening action from moving the bottle stopper in an upward direction and moving out of the bottle. The self-plugging halts the bottle stopper movement is in a range between over 60% to less than 100% movement out of the bottle. The self-plugging prevents the bottle stopper from flying out of the bottle and is a safety feature. The specification discloses two embodiments of the bottle stopper: a first aspect and best mode is the bottle stopper with an activation cap assembled in the center, and a second alternative aspect is the bottle stopper with the activation cap assembled on the side.

Figure 1:
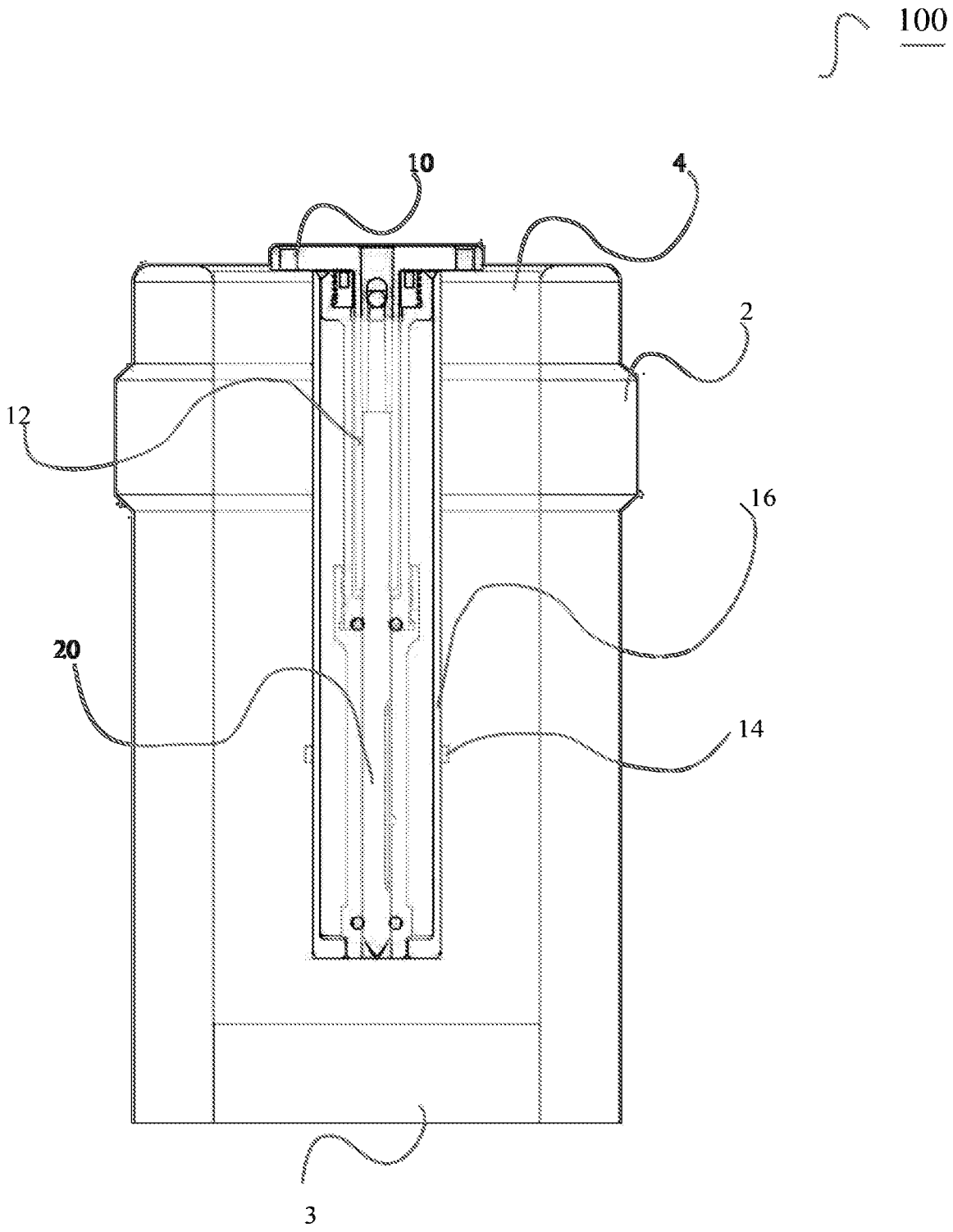
FIG. 1 shows a sectional view of a self-opening and self-plugging bottle stopper in a beverage bottle.

FIG. 1 showing a sectional view device 100, a self-opening and self-plugging bottle stopper inserted in a bottle. In some embodiments, the device 100 is for bottling beverages. In some embodiments, the bottle stopper is for bottling liquids that are non-beverages. A bottle 2 contains a self-opening and self-plugging bottle stopper comprising a cylindrical cover 4 and a cartridge 16. The cylindrical cover 4 has a first bottom end with a closed end and a second top end with an open end that is operative to receive the cartridge 16, wherein sizing and shaping the cylindrical cover to plug, (cork) a bottle. In some embodiments, the cartridge 16 is a gas cartridge. In some embodiments, drilling the cylindrical cover from a solid material forms a hollow cylindrical cover. In some embodiments, the hollow cylindrical cover measurements before insertion into the bottle has an inner diameter with a range from 10 millimeters to 11 millimeters, an outer diameter with a range from 24 millimeters to 25 millimeters, a vertical height along the longitudinal axis having a range from 43 millimeters to 45 millimeters. In some aspects, the vertical height is from 37 millimeters to 40 millimeters as measured on the Golan Heights Winery plugs. In some aspects, the vertical heights may be in other ranges. In some aspects, the bottle has an opening with a diameter whose range is from 17 millimeters to 18 millimeters. In some embodiments a cylindrical cover comprises a material selected from the following group: bark of cork oak tree; and synthetic plastics. In some embodiments, manufacture the cylindrical cover is from cork powder. In some embodiments, the bottle stopper is a wine stopper. In other aspects, the bottle stopper is a champagne stopper. In some aspects, the bottle stopper is for beer, seltzer, and other drinkable beverages. In some aspects, the bottle stopper is for other non-beverage fluids, not fit for human, animal or living creatures to consume.

The cylindrical cover 4 encompasses the cartridge 16, wherein the cartridge has at least one lateral protrusion 18 positioned thereon. The cartridge 16 is an external shell for the assembly of elements inside, as described later. The reference number 16 can refer to either the entire cartridge or to an external body cover that has a cylindrical shape, where the context of a sentence shows the intent. Positioning at least one lateral protrusion 18 on a cartridge 16 along the horizontal axis of the bottle is to join the cartridge to the cylindrical cover 4. Upon insertion into a bottle, pressure of the bottle diameter hole against the cylindrical cover 4 causes a contracting in diameter of the bottle stopper where the cylinder cover presses against the at least one lateral protrusion 18 extending out of the body cylindrical cover to cause a joining action, as described further on in the document.

Figure 2:
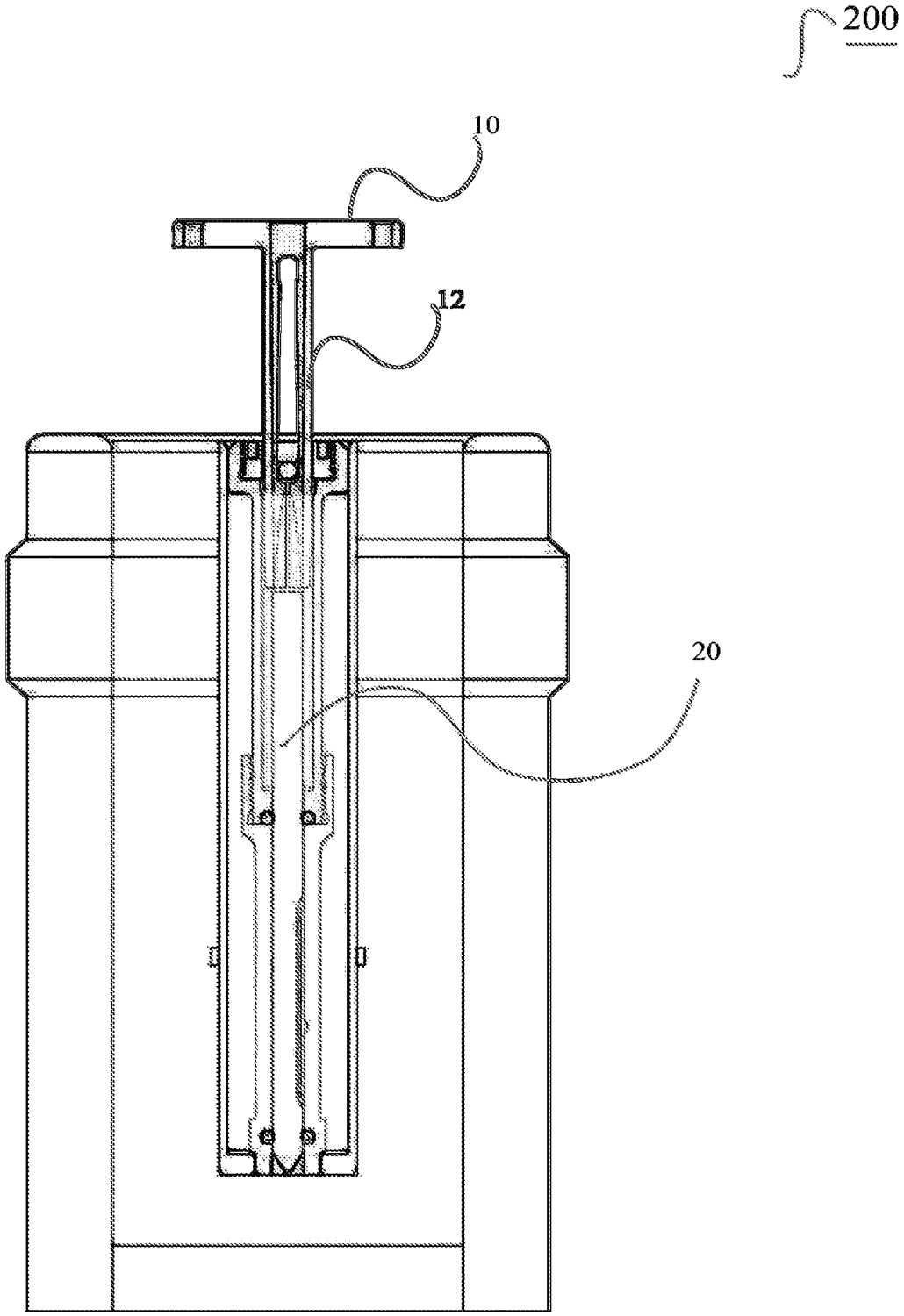
FIG. 2 shows a sectional view of activating a self-opening and self-plugging bottle stopper.

An activation cap 10 has a cylindrical protrusion 12 mounted on a conduit 20, where the activation cap and the conduit are elements assembled in the cartridge 16. The conduit has at least one inlet and at least one outlet; the conduit forming a conduit and the conduit mounted in the cartridge;

FIG. 2 shows a sectional view 200 of activating a self-opening and self-plugging bottle stopper by pulling an activation cap 10 upwards from the bottle 2. Although not shown in FIG. 2, assembling a ring, or tab, string, or other mechanical onto the top of the activation cap 10 enables the pulling. In some embodiments, a spring is for the pulling. This act of first pulling and a second pushing act is a sequence to provide a safety against inadvertent activating the self-opening and self-plugging bottle stopper. FIG. 2 shows the second of two steps for activating a self-openable bottle stopper. The first step-1 is the act of pulling an activation cap 10 from an initial position where the cylindrical protrusion 12 initially mounts over and covers a portion of the conduit 20 and where a portion of the conduit is disposed inside of the cylindrical protrusion 12. Step-2 shows the separation of the cylindrical protrusion 12 from the conduit 20 after pulling the activation cap 10 in an upward direction, where the cylindrical protrusion 12 now mounts on the top distal end of the conduit 20 and is not ingesting the conduit 20. In a preferred embodiment, the cylindrical protrusion 12 has prongs to ingest the conduit 20 and closes via contraction to enable pushing the conduit. In another aspect, the conduit expands to a radius larger than that of the prongs to enable pushing.

Figure 3:
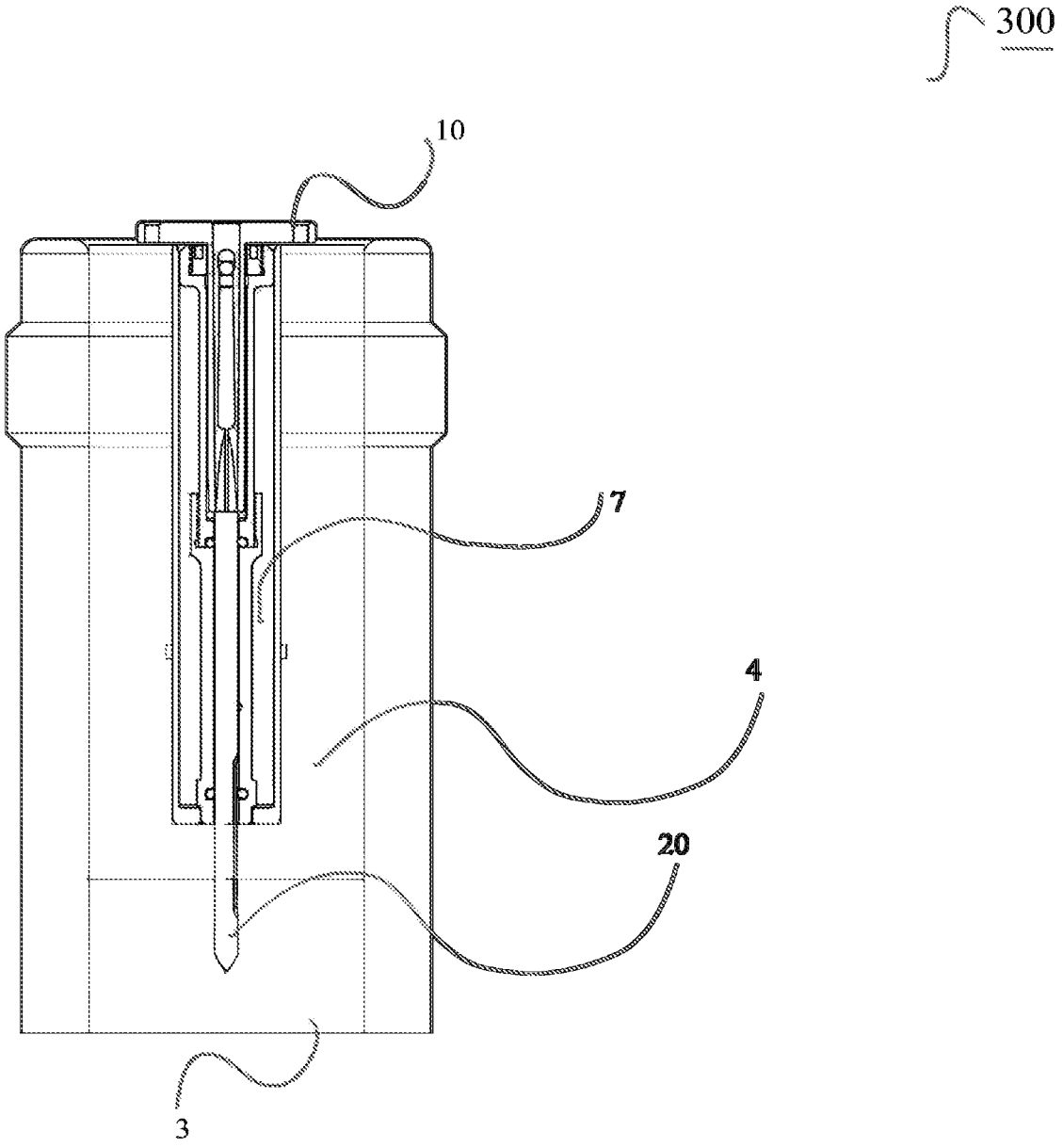
FIG. 3 shows a sectional view of a self-opening and self-plugging bottle stopper releasing gas into a beverage bottle.

FIG. 3 shows a sectional view 300 of a self-opening and self-plugging bottle stopper releasing a fluid into a bottle. This figure shows an additional two steps for activating a self-openable bottle stopper. In step-3, there is the pushing an activation cap 10 downwards along the longitudinal axis of the bottle to move the conduit 20. Step-4, comprises the piercing of a first closed end of a bottle stopper via moving the conduit downwards along the longitudinal axis of the bottle, where the conduit 20 now moves beyond the bottom end for fluidly connecting a fluid chamber 7 disposed in cartridge 16 to a space 3 in the bottle. In some embodiments, the space 3 is a vacuum.

The cartridge 16 has a fluid chamber 7 for fluidly connecting to a space 3 below the bottom end. The activation cap 10 mounts on the top distal end of the conduit to push the conduit, having at least one inlet and at least one outlet from a closed state to an open state. In the open state, the conduit 20 with at least one outlet extends beyond the bottom end of the bottle stopper and the conduit with at least one inlet fluidly connects the space 3 to the fluid chamber 7 inside the cartridge. As disclosed below in FIG. 4, at least one fluid channel 5 fluidly connects between a space 3 below the bottom end of the bottle stopper to above the top end of the bottle stopper to release fluid 6; wherein the fluid channel 5 forms in a space between the cartridge 16 and the cylindrical cover 4.

Figure 4:
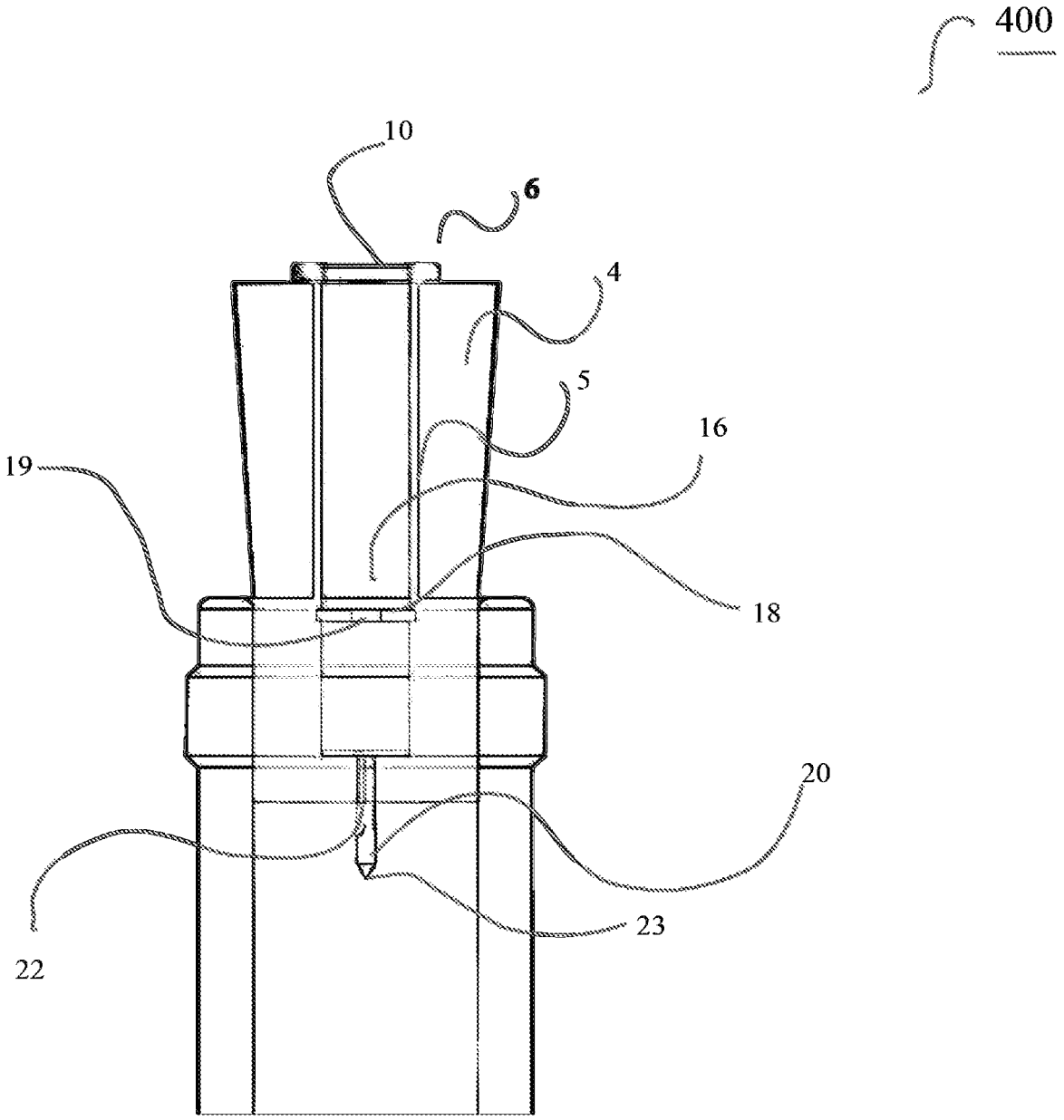
FIG. 4 shows a sectional view of the egression of a bottle stopper out of a beverage bottle.

FIG. 4 is a sectional view 400 showing the cylindrical cover 4 and an external shell of the cartridge 16 for self-opening and self-plugging a bottle stopper. The cartridge 16 having an internal fluid chamber provides a fluid via conduit 20 having at least one inlet and at least one outlet to form an input port and an output port 22 for fluidly connecting to a space 3 below the bottom end of the bottle stopper. In some aspects the conduit extends beyond the bottom end for entering the bottle; where the conduit has a conduit tip 23 in a range between a 30 to a 60-degree angle measured along the longitudinal axis of the bottle. In one aspect, the form and shape of the conduit tip 23 is round and lessens in circumference with to a point with an angle in a range between 30 to a 60-degree a measured along the longitudinal axis of the bottle. In some aspects, the conduit tip 23 is configured to prevent damaging the bottom end of the outer cylindrical cover 4 when entering the bottle; pieces of the cylindrical cover 4 do not flake, or break off, or fall into the bottle such that when the conduit pierces the cylindrical cover 4 and enters the space 3, only the conduit 20 and only the contents of the fluid chamber enter the space 3 below the bottom end. FIG. 4 shows fluid 6 exiting above the top end of the bottle, The fluid 6 moves through at least one fluid channel 5 for fluidly connecting between a space 3 below the bottom end of the bottle stopper and fluidly connecting to above the top end of the bottle stopper, wherein the fluid channel 5 forms between the cartridge 16 and the cylindrical cover 4.

The activation cap 10 mounts on the conduit 20 for pushing the input and output ports 22 of the bottle stopper from a closed state to an open state. In the open state, the at least one output port 22 extends beyond the bottom end and the at least one inlet fluidly connects to the fluid chamber, wherein at least one fluid channel fluidly connects between a space below the bottom end and fluidly connects above the top end of a bottle stopper for self-opening. The self-plugging occurs when the bottle stopper moves up to a level on the horizontal axis of the bottle to at least one gap 19 and next to at least one lateral protrusion 18. The self-plugging prevents egression of a bottle stopper from a bottle.

The bottle stopper moves upwards along a longitudinal axis with a force exerted by the fluid 6 entering the beverage bottle 2. the cartridge 16 having the at least one lateral protrusion joining to the cylindrical cover for moving in tandem, for pushing the bottle stopper upward to unplug the bottle. As the bottle stopper moves upward, the fluid channel 5 between the cartridge 16 and the cylindrical cover 4, can egress fluid 6 out of the bottle 2. In some embodiments, the fluid channel during the open state is between the cartridge having at least one lateral protrusion and the cylindrical cover 4 further comprises at least one gap 19 next to the at least one protrusion. In some embodiments, the fluid chamber provides a fluid pressure greater than 5 bars to move the cylindrical cover joined to the cartridge, having the at least one lateral protrusion, both in tandem to unplug (uncork). In some embodiments, the at least one gap lowers the fluid pressure to less than 5 bars. In some aspects, the self-plugging halts the bottle stopper with a range of 9 millimeters to 11 millimeters from the top end of the bottle. In some aspects, the bottle stopper halts after moving upward in a range from 30 millimeters to 38 millimeters.

After the self-plugging process is complete, the bottle stopper halts in a raised, higher position along the longitudinal axis of the bottle as shown in FIG. 4. The user then pulls on the bottle stopper manually for opening the bottle. The conduit 20 can extend below the bottom end of the bottle stopper after removing the bottle stopper and the user can move the conduit 20 back into the bottle stopper by pushing on it in an upwards direction along the longitudinal axis of the bottle stopper. In some aspects, the user may push the conduit 20 against a hard surface because of the conduit pin 23. In some aspects, the user can grab the conduit 20 and push it in an upwards direction. There is no danger, or threat of stabbing a person as the conduit 20 is not prevented from moving upwards when pushing against the skin of a person.

In some embodiments, a wine stopper cartridge has a fluid containing nitrogen (N2) and wherein the nitrogen (N2) has a pressure range between a lower limit of 45 bars and a higher limit of 47 bars. In some embodiments, a wine stopper closes a wine bottle having a pressure range in a space 3 between a lower limit of 2.4 bars and a higher limit of 7 bars. 17. In some aspects, the self-opening can move the bottle stopper upward in a direction along the longitudinal axis of the bottle until the self-plugging halts the upwards movement in a range at the level of the at least one gap 19 between the at least one lateral protrusion 18. In some aspects, the fluid may be carbon dioxide, argon, helium, xenon, nitrogen and krypton or mixtures thereof.

Figure 5:
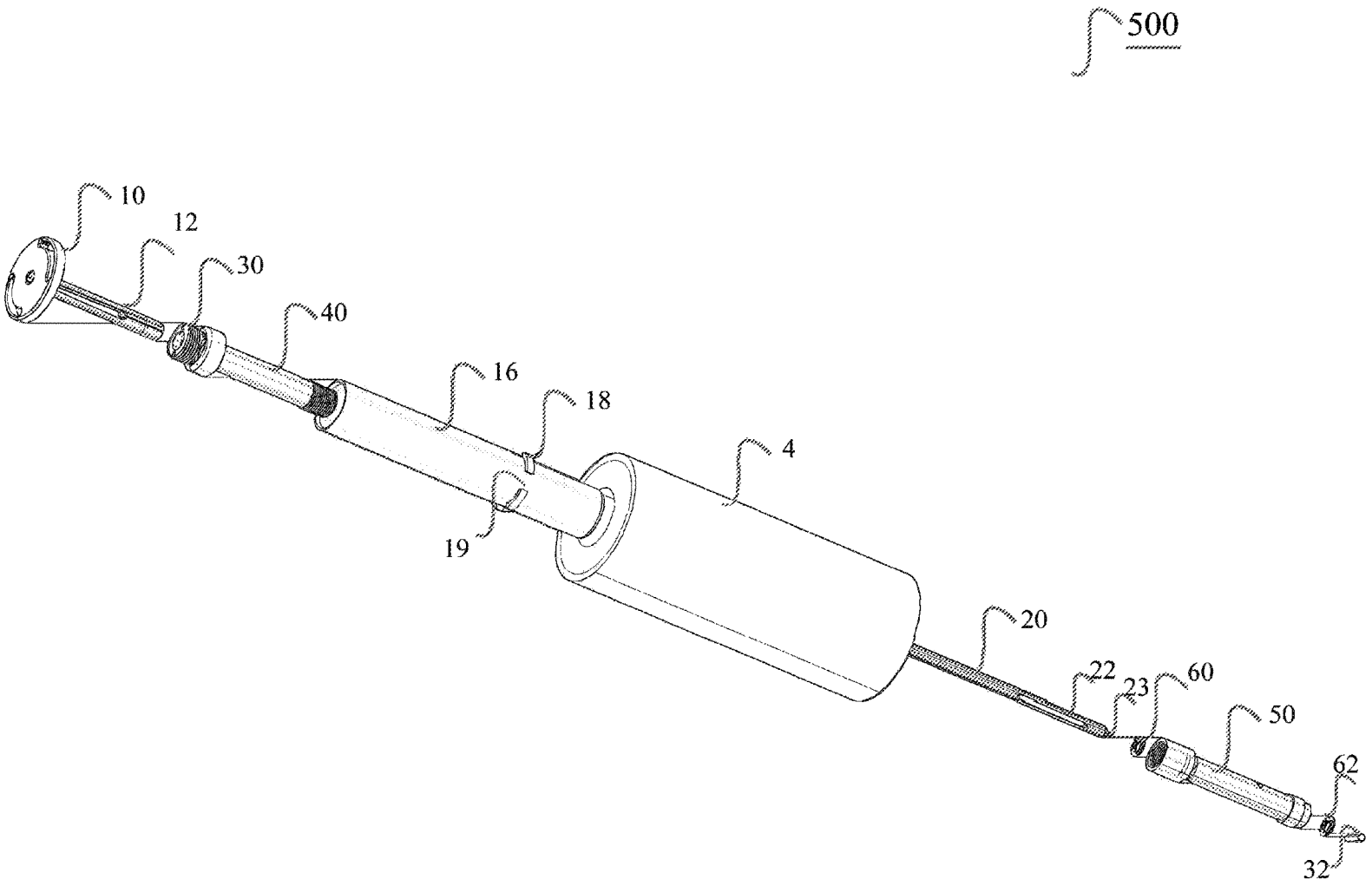
FIG. 5 shows an exploded-view of a self-opening and self-plugging bottle stopper.

FIG. 5 shows an exploded-view 500 of a self-opening and self-plugging bottle stopper comprising: activation cap 10, cylindrical protrusion 12, closing nut 30, upper valve 40, cartridge 16, at least one lateral protrusion 18, cylindrical cover 4, conduit 20, input and output ports 22, conduit tip 23, O-ring 60, lower valve 50, O-ring 62, and pin 32.

FIG. 6*a* shows elements 600 of an activation cap 10. The cylindrical protrusion 12 attaches to the top cover of the activation cap 10. The cylindrical protrusion 12 comprises a hollow and further comprises two slits, a first upper slit 13 that is shown wider than a second lower slit 14. The lower slit provides tension to act as a prong for grasping a conduit 20.

FIG. 6*b* shows one aspect 610 of an activation cap 10 with a pull-ring 11. In some embodiments, a tab, string, or other mechanical means can enable pulling. In embodiments, a spring can enable the pulling action to push the activation cap 10 in an upward direction. In some aspects, the pulling sequence provides a level of safety for inadvertently activating the self-opening and self-plugging bottle stopper.

FIG. 7 shows an assembly of 700, having activation cap 10 with a conduit 20. An upper distal end of the conduit 20 mounts inside the hollow area of the cylindrical protrusion 12, where the conduit 20 extends into a first upper slit 13 and through a second lower slit 14. The conduit 20 has at least one input and at least one output port 22 to egress fluid when the conduit moves through a lower O-ring 62 as explained further below in FIG. 8. The conduit also has a point 23 to allow piercing of the bottom end of the bottle stopper as shown in FIG. 3 and FIG. 4. In some embodiments the input and output ports 22 comprise at least one groove formed on the longitudinal axis of a conduit.

The conduit 20 has a top end positioned vertically, along a longitudinal axis, coupling to the activation cap 10, wherein the activation cap 10 has a cylindrical protrusion 12 forming at least two prongs at a bottom end for coupling to the conduit 20. Pulling the activation cap causes the at least two prongs to separate from the conduit. Pulling can cause contracting and expanding, where the prongs are a first element and where the conduit is a second element, the first and second elements are selected from a group consisting of: (1) the prongs are contracting in diameter and there is no change to the conduit, and (2) the conduit is expanding in diameter and there is no change to the prongs.

FIG. 8 shows elements 800, which includes the assembly 700 described above, a closing nut 30, a pin 32, and O-rings 60 and 62. The pin 32 is seated in the closing nut 30 pin and functions as a locking pin, passing thorough the first slit 13 to prevent the activation cap 10 from being removed when pulling during the activation process/act. The O-rings 60 and 62 are mounted inside a valve as described below to allow sliding of the conduit 20.

FIG. 9 shows elements 900 of an upper valve 40, cylindrical and hollow. The threading 42 on the first distal end of the upper valve 40 connects to a closing nut 30. Threading 44 on a second distal end of the upper valve 40 connects to the lower valve 50. The upper valve 40 ingests the activation cap along the longitudinal axis of the bottle. In some aspects, the upper valve 40 can take other shapes, such as a square, pentagon, hexagon, and octagon.

FIG. 10 shows elements 1000 of a lower second valve 50, which is cylindrical and hollow having at least one fluid ingress inlet 54. There is a threading 52 on the first distal end of the lower valve 50 operative to connect to the threading 44 on the second distal end of the upper valve 40. The O-rings 60 and 62 assemble within the lower valve 50, one O-ring mounted at each distal end to encompass the conduit 20 ingested inside the lower valve 50. The O-rings 60 and 62 facilitate a sliding motion of the conduit 20 along the longitudinal axis of the bottle. The conduit 20 further comprises at least one input and at least one output port 22 formed on one lower distal end to provide a path to allow fluidity. In the closed state, the lower valve has at least two O-rings 60 and 62 encompassing the at least one input and the at least one output port 22, wherein the at least one inlet and the at least one outlet between O-rings 60 and 62 for preventing fluidity to a space 3. In the open state, the at least one inlet fluidly connects to the fluid chamber through the at least one fluid ingress inlet 54 and the at least one outlet extends beyond the at least one O-ring 62 to extend beyond the bottom end; wherein the at least one input and at least one output port 22 fluidly connects to a space 3 below the bottom end.

FIG. 11 shows a sectional view showing elements 1100 of the bottle stopper before inserting into a bottle. The cylindrical cover 4 cylindrical cover measurements before insertion into the beverage bottle are: (1) an outer diameter 76 with a range from 24 millimeters to 25 millimeters, (2) an inner diameter 72 with a range from 10 millimeters (mm) to 11 millimeters, (3) a vertical height 74 of 44 millimeters along the longitudinal axis of the bottle, wherein the bottle 2 has an opening with a diameter 1 in a range from 17 millimeters to 18 millimeters. A bottle stopper insertion device 70 illustrate how a pressure for inserting the bottle stopper and the amount of contraction the cylindrical cover experiences as it enters the beverage bottle 2. The diameter of the drill bit for drilling into a cylindrical cover 4 is preferable for best mode with a diameter of 10.1 millimeters. The at least one fluid channel 78 is shown between the cartridge 16 and cylindrical cover 4.

FIG. 12 is a perspective view of 1200 showing a close-up view of the at least one gap 19 on the cartridge 16, and between the protrusions 18. In a preferred embodiment, the lateral protrusion 18 has the following measurements: 17*a* having a lateral protrusion on the horizontal axis with a range between 0.55 to 0.6 millimeter towards the cylindrical cover, 17*b* has 1 mm vertical height along the longitudinal axis of the bottle, and 17*c* having a range between 8.0 to 9.0 millimeter around circumference of the cartridge 16. In some aspects there is a preference for four lateral protrusions 18. In some aspects, the cartridge 16 comprises steel walls suitable for welding selected from a group comprising: L304; and L316. FIG. 12 does not show valves as assembly of the upper valve 40 connecting to a lower valve 50 via male and female screwing connections, 52 and 44 are inside the cartridge 16 along with the conduit 20 and other elements described above.

FIG. 13 shows a perspective view of 1300 of an activation cap assembled on the side of the cartridge. In some aspects, the self-opening and self-plugging bottle stopper does not have valves, as shown in the above figures for the embodiment of the assembly cap 10 assembled in the center. The side activation cap 10 that is side assembled can comprise: activation cap 10, cylindrical protrusion 12, closing nut 30, cartridge 16, at least one lateral protrusion 18, cylindrical cover 4, conduit 20, at least one input and at least one output port 22, conduit tip 23, O-ring 60, O-ring 62, and pin 32. A fluid chamber 130 is shown in FIG. 13.

In some aspects the self-opening and self-plugging bottle stopper can have valves and comprises: activation cap 10, cylindrical protrusion 12, closing nut 30, upper valve 40, cartridge 16, at least one lateral protrusion 18, at least one gap 19, cylindrical cover 4, conduit 20, at least one input and at least one output port 22, conduit tip 23, O-ring 60, lower valve 50, O-ring 62, and pin 32.

A person having skill in the art can redesign the center mounted/assembled activation cap into a variety of aspects. Some of the important features common to all aspects are: the at least one lateral protrusion 18, activation cap 10 with a cylindrical protrusion 12, conduit 20 with inlet/outlet ports, O-rings 60/62, and at least one gap 19.

The following is a method for manufacturing bottle stoppers.

A method of manufacturing bottle stoppers, the manufacturing method comprising the following steps: (1) inserting via a molding machine, a cartridge having at least one lateral protrusion into a mold; adding via a molding machine, a cork powder for molding into a cylindrical cover; (2) the cylindrical cover is joining to the cartridge, having at least one lateral protrusion; heating the mold comprising the cartridge having at least one lateral protrusion with the cork powder; wherein the cork powder joins with the cartridge having at least one lateral protrusion; and cooling the mold for forming the solid self-opening and self-plugging bottle stopper. In some aspects, heating the mold to a maximum of 130 degrees Celsius for forming the bottle stopper adapted for self-opening and self-plugging. In some aspects, the cartridge 16 has a maximum 140 bar pressure limit during the heating of the mold. In some aspects, the manufacture of the conduit 20 is from a plastic material to lower product costs. In some aspects; the manufacture of the conduit 20 is from a metallic, ceramic, or other solid material.

FIG. 14 is a perspective view showing elements 1400 of the bottle plugging tool 80. The lower distal end 81 is operative to ingest the self-opening and self-stopping beverage stopper for aligning, contracting and pushing the bottle stopper into a bottle. At least one indentation 83 on the bottle plugging tool 80 is for providing a planar surface to connect to a pressing apparatus. The pressing apparatus can be robotic and does not require human intervention. A depression 82 on the top distal end of the bottle plugging tool 80 is for providing a point for a downwards pressure so the pressing apparatus can plug a bottle.

The following are methods of a mechanized bottle plugging tool to plug a self-opening and self-stopping beverage stopper:

A method of a mechanized bottle plugging tool for a self-opening and self-stopping beverage stopper into a bottle, the method of a mechanized bottle plugging tool comprising the following steps:

(a) loading via a plugging machine, a cartridge encompassed by a cylindrical cover for insertion into a bottle; wherein the cartridge encompassed by a cylindrical cover forms a plug;

(b) aligning the plug on the top of the bottle via the corking machine;

(c) pushing the plug into the bottle via the corking machine;

(d) contracting the plug diameter via the corking machine during the pushing step (c); wherein the cylindrical cover joins with the cartridge; wherein the cartridge further having at least one lateral protrusion positioned thereon and at least one gap; wherein the force applied during contraction joins the cylindrical cover joins with the cartridge; and (e) plugging until the top of the activation cap is substantially level with the top of the bottle via the plugging machine.

The method of claim 20, wherein step (a) is further comprising:

loading via the plugging machine, a solid plug for insertion into a bottle;

drilling the solid plug to form a hollow cylindrical cover; wherein the bottle plugging tool drills the solid plug to form a hollow cylindrical cover, wherein the bit diameter is about 10.1 millimeters;

inserting a cartridge having at least one lateral protrusion and at least one gap into the hollow cylindrical cover via the corking machine; and continuing with step (b).

FIG. 15 further shows a perspective view of a bottle plugging tool with a fluid inlet port 84 operative for connecting to a fluid compressor configured for creating a force or vacuum facilitate in the process to plug the self-opening and self-stopping beverage stopper into the bottle.

The descriptions of the various embodiments, options, and aspects of the description have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant methods and systems will be developed and the scope of the term a processor, an active sensor system, coding and modulation is intended to include all such new technologies a priori.

As used, the terms self-opening and self-plugging bottle stopper and bottle stopper are synonymous.

As used, the term "about" refers to ±10%.

The terms "comprises", "comprising", "includes", "including", "having" and their conjugates means "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the description may include a plurality of "optional" features unless such features conflict.

Throughout this application, various embodiments of this description may be presented is in a range format. It should be understood that the description in range format is merely for convenience and brevity and should not be construed as an inflexible limitation on the scope of the description. Accordingly, the description of a range should be considered to have specifically disclosed all the possible subranges as well as individual numerical values within that range. For example, description of a range such as from 1 to 6 should be considered to have specifically disclosed subrange such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals there between.

It is appreciated that certain features of the description, which are, for clarity, described in the context of separate embodiments, may also be provided in combination with a single embodiment. Conversely, various features of the description, which are, for brevity, described in the context of a single embodiment, may also be provided separately or in any suitable sub-combination or as suitable in any other described embodiment of the description. Certain features described in the context of various embodiments are not to be considered essential features of those embodiments, unless the embodiment is inoperative without those elements.

Although the description has been described in conjunction with specific embodiments thereof, it is evident that many alternatives, modifications and variations will be apparent to those skilled in the art. Accordingly, it is intended to embrace all such alternatives, modifications and variations that fall within the broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A bottle stopper adapted for self-opening and self-plugging a bottle, comprising:

a cylindrical cover having a bottom end and a top end, wherein the cylindrical cover is sized and shaped to plug the bottle;

a cartridge encompassed by the cylindrical cover and having:

a fluid chamber, at least one lateral protrusion thereon to form between the cartridge and the cylindrical cover at least one fluid channel for fluidly connecting between a space below the bottom end and above the top end;

a conduit having at least one inlet and at least one outlet; and an activation cap mounted to push the conduit along a longitudinal axis of the cylindrical cover from a closed state to an open state;

wherein in the open state, the at least one outlet extends beyond the bottom end and the at least one inlet is fluidly connected to the fluid chamber;

wherein in the closed state the at least one outlet and the at least one inlet are mounted between the bottom end and the top end.

2. The bottle stopper of claim 1, further comprising a conduit tip having a range between a 30 to a 60 degree angle measured along the longitudinal axis of the bottle.

3. The bottle stopper of claim 1, wherein the cylindrical cover is a solid cylindrical cover drilled to create a hollow cylindrical cover.

4. The bottle stopper of claim 3, wherein the hollow cylindrical cover having the following dimensions: (1) an inner diameter in a range between 9.5 millimeters and 11 millimeters, (2) an outer diameter in a range between 24 millimeters and 25 millimeters, and (3) a vertical height in a range between 43 millimeters and 45 millimeters.

5. The bottle stopper of claim 4, wherein the lower valve has at least one inlet thereon to ingress the fluid from the fluid chamber into the lower valve;

wherein in the closed state, the lower valve has at least two O-rings encompassing the conduit, wherein the at least one inlet and the at least one outlet are located between the at least two O-rings;

wherein in the open state, the at least one inlet is fluidly connected to the fluid chamber and the at least one outlet extends beyond at least one of the at least two O-rings for the at least one outlet to extend beyond the bottom end.

6. The bottle stopper of claim 5, wherein the conduit has a top end positioned vertically coupling to the activation cap, wherein the activation cap has a cylindrical protrusion forming at least two prongs at a bottom end for coupling to the conduit; wherein pulling the activation cap causes the at least two prongs to separate from the conduit.

7. The bottle stopper of claim 6, wherein the conduit is positioned in the center of the cartridge.

8. The bottle stopper of claim 6, wherein pulling the activation cap cause contracting and expanding, where the at least two prongs are a first element and where the conduit is a second element, the first and second elements are selected from a group consisting of: (1) the at least two prongs are contracting in diameter and there is no change to the conduit, and (2) the conduit is expanding in diameter and there is no change to the prongs.

9. The bottle stopper of claim 8, wherein the bottle stopper plugs a wine bottle.

10. The bottle stopper of claim 9, wherein the wine bottle has a wine bottle pressure range between 2.4 bars and 7 bars; wherein in the open state a fluid pressure greater than 5 bars moves the bottle stopper to unplug the bottle.

11. The bottle stopper of claim 10, wherein the fluid chamber of the bottle stopper contains a nitrogen fluid; wherein the fluid chamber having a pressure range between 45 bars and 47 bars.

12. The bottle stopper of claim 8, wherein the bottle stopper is a champagne stopper for a champagne bottle.

13. The bottle stopper of claim 4, wherein the conduit is positioned along the side of the cartridge.

14. The bottle stopper of claim 1, wherein the cartridge further comprises an upper valve connecting to a lower valve via a male and female screwing connection; wherein cartridge having steel walls suitable for welding selected from a group consisting of: L304, and L316.

15. The bottle stopper of claim 14, wherein the upper valve having a top end connecting to a closing nut and a pin assembled in the closing nut; wherein the activation cap further comprises a cylindrical protrusion with at least one slit; wherein the pin is a locking pin passing thorough the at least one slit to prevent removing the activation cap from the upper valve.

16. The bottle stopper of claim 1, wherein the cartridge having at least one lateral protrusion further comprises at least one gap adjacent to the at least one protrusion joining to the cylindrical cover for moving in tandem to unplug the bottle during the open state.

17. The bottle stopper of claim 16, wherein the at least one gap lowers the fluid pressure from moving the bottle stopper upwards; wherein the bottle stopper halts after moving upwards in a range from 30 millimeters to 38 millimeters.

* * * * *